US009518794B2

(12) United States Patent
Sotiropoulos

(10) Patent No.: US 9,518,794 B2
(45) Date of Patent: Dec. 13, 2016

(54) INTERCHANGEABLE CHOKE TUBE FOR THE SHOT LOAD OF SMOOTHBORE SHOTGUN WHICH CAUSES TO THE SHOT LOAD GRADUALLY INITIAL TIGHTENING OF PROGRESSIVE FORM, EXPANSION AND FINAL RETIGHTENING

(71) Applicant: Christos Sotiropoulos, Athens (GR)

(72) Inventor: Christos Sotiropoulos, Athens (GR)

( * ) Notice: Subject to any disclaimer, the term of this patent is extended or adjusted under 35 U.S.C. 154(b) by 72 days.

(21) Appl. No.: 14/420,879

(22) PCT Filed: Aug. 26, 2013

(86) PCT No.: PCT/GR2013/000044

§ 371 (c)(1),
(2) Date: Feb. 10, 2015

(87) PCT Pub. No.: WO2014/033486

PCT Pub. Date: Mar. 6, 2014

(65) Prior Publication Data

US 2015/0204630 A1 Jul. 23, 2015

(30) Foreign Application Priority Data

Aug. 27, 2012 (GR) ..... 20120100435

(51) Int. Cl.
*F41A 21/40* (2006.01)

(52) U.S. Cl.
CPC ..... *F41A 21/40* (2013.01)

(58) Field of Classification Search
CPC ..... F41A 21/40; F41A 21/16; F41A 11/06
(Continued)

(56) References Cited

U.S. PATENT DOCUMENTS 863,431 A * 8/1907 Parker ..... F41A 21/40 42/79
1,227,987 A * 5/1917 Wright ..... F41A 21/40 42/79

(Continued)

OTHER PUBLICATIONS

Lampel W et al.: "Waffenlexikon Ed. 9", Jan. 1, 1981, Waffen Lexikon /Reg 59/82, BLV Verlagsgesellschaft; DE, Munchen, pp. 54-57.

(Continued)

*Primary Examiner* — Troy Chambers
*Assistant Examiner* — Bridget Cochran
(74) *Attorney, Agent, or Firm* — Donn K. Harms

(57) ABSTRACT

Interchangeable choke tube for the shot load of smoothbore shotgun which causes to the shot load gradually initial tightening of progressive form, expansion and final retightening (7), featuring internally initial tightening of progressive form section (8) followed by expansion section (9) and which is followed by final retightening section (10), which achieves the improvement of the effectiveness of the shot as, first, the initial tightening of progressive form section (8) featured applies to the shot charge, as it passes through it, vertical lateral pressure which splits the aggregates of shot pellets and second, the expansion section (9) which follows causes ameliorative rearrangement of the shot pellets as they are deploying in a space with larger diameter and, in this way, and their smoother entrance into the final retightening section (10) with result the improvement of their distribution within their pattern, something that is not happening with the hitherto existing ones.

15 Claims, 2 Drawing Sheets

(58) Field of Classification Search
USPC ..... 42/79
See application file for complete search history.

(56) References Cited

U.S. PATENT DOCUMENTS 1,773,260 A * 8/1930 Cutts ..... F41A 21/40 42/79
1,858,560 A * 5/1932 Rosenstiel ..... F41A 21/40 42/79
2,054,132 A * 9/1936 Lewis ..... F41A 21/16 42/79
2,098,617 A * 11/1937 Cutts, Jr. ..... F41A 21/36 42/79
2,417,721 A * 3/1947 Whedon ..... F41A 21/40 42/79
2,453,121 A * 11/1948 Cutts ..... F41A 21/36 42/79
2,466,400 A * 4/1949 Ennis ..... F41A 21/40 42/79
2,512,850 A * 6/1950 Crandall ..... F41A 21/40 42/79
2,828,569 A * 4/1958 Steane ..... F41A 21/42 42/79
2,894,348 A * 7/1959 Cutts ..... F41A 21/42 42/79
2,984,926 A * 5/1961 Havlin ..... F41A 21/42 42/79
3,408,762 A * 11/1968 Durao ..... F41A 21/40 42/79
4,058,925 A * 11/1977 Linde ..... F41A 21/40 42/76.1
5,452,535 A * 9/1995 See ..... F41A 21/46 42/79
6,079,311 A * 6/2000 O'Quinn ..... F41A 21/30 42/79
6,421,945 B1 * 7/2002 Hengstenberg ..... F41A 21/40 42/51

OTHER PUBLICATIONS

International Search Report, Jan. 21, 2014, from International Phase of the instant application.

* cited by examiner

INTERCHANGEABLE CHOKE TUBE FOR THE SHOT LOAD OF SMOOTHBORE SHOTGUN WHICH CAUSES TO THE SHOT LOAD GRADUALLY INITIAL TIGHTENING OF PROGRESSIVE FORM, EXPANSION AND FINAL RETIGHTENING

BACKGROUND OF THE INVENTION

Field of the Invention

The invention relates to shotguns.

Prior Art

The shots of a shotgun's charge, immediately after leaving the barrel, form a bunch cluster, the diameter of which expands as its distance from the shotgun increases. From a certain point and after that, the diameter of this bunch cluster increases so that within the shot pattern empty spaces are formed, such that the shot charge is no longer effective as the target, when these empty spaces become larger than that, can no longer be hit.

For this reason, at the last before the exit front part of the internal of shotgun barrels there is a constriction, i.e. reduction of the internal diameter in the muzzle area in relation to the rest of the barrel bore, in order to tighten the shot charge so that the shot pellets maintain the effective density of their pattern without gaps etc. at a longer distance from the muzzle than the one at which they would had lost it due to significant spread if there was no the constriction at the exit. This constriction varies depending on the distance at which is sought to be achieved the most effective in its density shot pattern diameter, from negative to small for shots at short distances, moderate for shots at medium distances and great for shots at long distances, with all intermediate gradations according to the intended use of each shotgun.

In recent decades, the part of the interior of the barrels at which there is the constriction is interchangeable, ie before the exit of the barrel there is internally a placement slot, at which is placed interchangeable cylindrical tube with fixation screw thread, which has internally the at each time desired by the user of the weapon constriction.

During the phase of detonation, the shot charge is accelerated within a few milliseconds from zero to hundreds of meters per second, with the result, in its course through the barrel bore, a number of shot pellets, due to the high pressure which develops between them, to undergo cold type welding and form aggregates consisting of 2 or more shot pellets. These aggregates, as they do not have spherical shape, in the course of the shot charge in the air after its exit from the barrel, are diverted from the desired path to the target, thereby reducing the effectiveness of the shot. Furthermore, they cause diversion to other nearby them shot pellets, thus worsening even further the reduction of the effectiveness of the shot as they cause bad shot pellet distribution within the diameter of their pattern.

SUMMARY OF THE INVENTION

The advantages of the present invention is that is achieved the split of the aggregates of shot pellets before leaving the barrel but also ameliorative rearrangement of the shot pellets with result their smoother entrance into the final constriction of the barrel for the formation of the desired diameter of their pattern, something that is not happening with the hitherto existing interchangeable choke tubes for the shot load of shotguns and which it has as result the improvement of the distribution of the shot pellets within the diameter of their pattern and consequently of the effectiveness of the shot.

BRIEF DESCRIPTION OF THE DRAWINGS

In FIG. (1) is shown in side external view a part of one of the many possible to be designed and constructed shotgun barrel (1) which includes its muzzle.

In FIG. (2) is shown in side external view one of the many possible to be designed and constructed interchangeable choke tube for the shot load of shotgun (2) with fixation screw thread (3) and with flattened front section (4) which is used as a handle for screwing the fixation screw thread (3).

Figure 1:
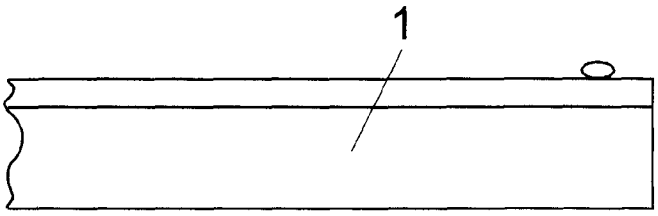
Figure 2:
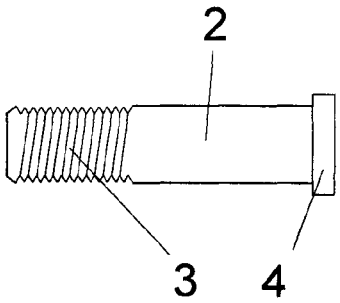
Figure 3:
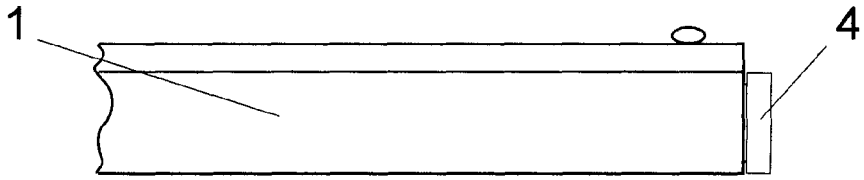
Figure 4:
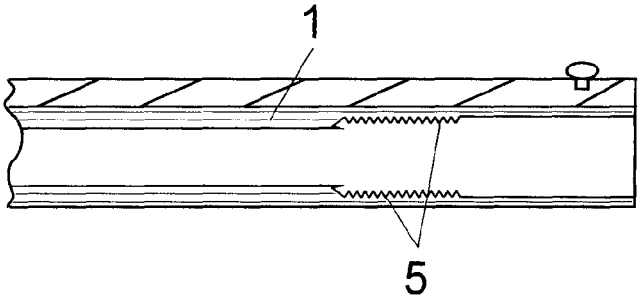
Figure 5:
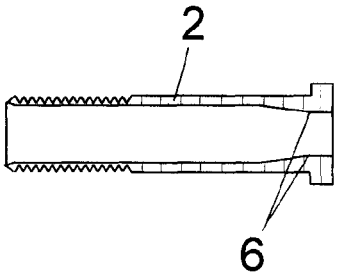
Figure 6:
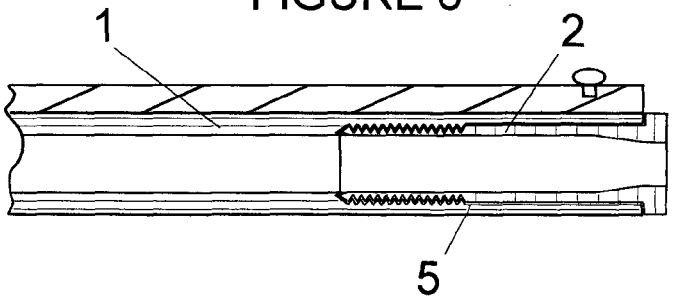
Figure 7:
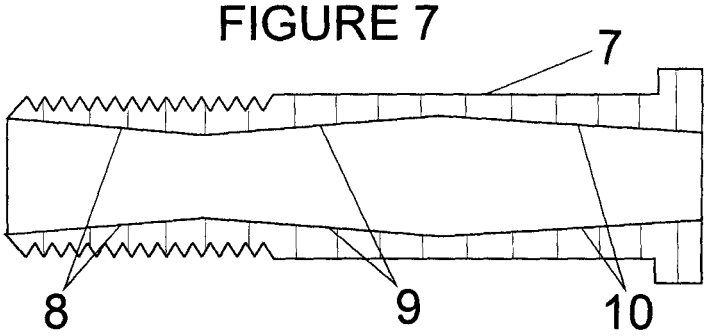
Figure 8:
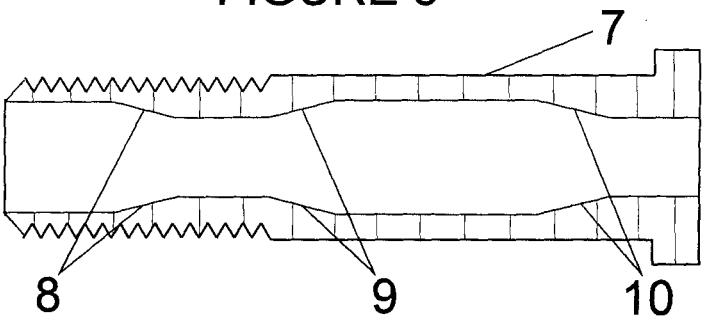
Figure 9:
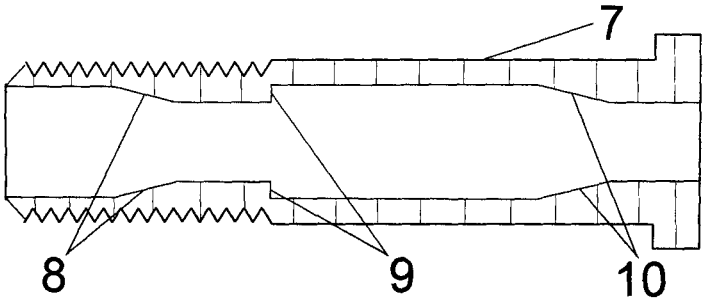
Figure 10:
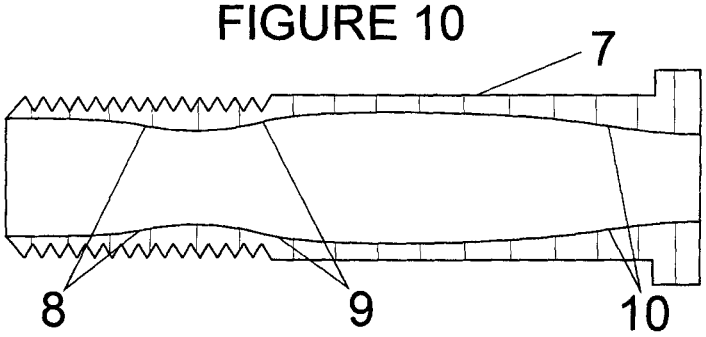

In FIG. (3) is shown in side external view the part of the barrel (1) of FIG. (1) with the interchangeable choke tube for the shot load of shotgun (2) of FIG. (2) placed inside it with its flattened front section (4) protruding.

In FIG. (4) is shown in side sectional view the part of the barrel (1) of FIG. (1) with one of the many possible to be designed and constructed placement slot (5) for interchangeable choke tubes for the shot load of shotgun (2).

In FIG. (5) is shown in side sectional view the interchangeable choke tube for the shot load of shotgun (2) of FIG. (2) with one of the many existing conventional type constriction section (6) of reducing internal diameter.

In FIG. (6) are shown in side sectional view the part of the barrel (1) of FIG. (4) with the interchangeable choke tube for the shot load of shotgun (2) of FIG. (5) placed in the placement slot (5).

In FIG. (7) is shown in side sectional view one of the many possible to be designed and constructed interchangeable choke tube for the shot load of smoothbore shotgun which causes to the shot load gradually initial tightening of progressive form, expansion and final retightening (7), featuring initial tightening of progressive form section (8) followed by expansion section (9) and which is followed by final retightening section (10) of the shot load, and in which the initial tightening of progressive form section (8) is formed by inner diameter reduction of conical shape, the expansion section (9) is formed by inner diameter increase of conical shape and the final retightening section (10) is formed by inner diameter reduction of conical shape again.

In FIG. (8) is shown in side sectional view one of the many possible to be designed and constructed interchangeable choke tube for the shot load of smoothbore shotgun which causes to the shot load gradually initial tightening of progressive form, expansion and final retightening (7), featuring initial tightening of progressive form section (8) followed by expansion section (9) and which is followed by final retightening section (10) of the shot load, at the beginning of which and before the initial tightening of progressive form section (8) there is a cylindrical section—entrance of shot pellets which is continuation of the interior of the barrel (1) and in which the initial tightening of progressive form section (8) is formed by inner diameter reduction of conical shape and towards the exit of the barrel abuts cylindrical section which is interposed between this and the expansion section (9), the expansion section (9) is formed by inner diameter increase of conical shape and towards the exit of the barrel abuts cylindrical section which is interposed between this and the final retightening section (10) and finally the final retightening section (10) is formed by inner diameter reduction of conical shape again and towards the exit of the barrel abuts cylindrical section which is interposed between this and the muzzle of the barrel (1).

In FIG. (9) is shown in side sectional view one of the many possible to be designed and constructed interchangeable choke tube for the shot load of smoothbore shotgun which causes to the shot load gradually initial tightening of progressive form, expansion and final retightening (7), featuring initial tightening of progressive form section (8) followed by expansion section (9) and which is followed by final retightening section (10) of the shot load, in which the expansion section (9) has the shape of a cylinder with base diameter larger than that of the initial tightening of progressive form section (8) and consequently the increase of the inner diameter is immediate and not gradual.

In FIG. (10) is shown in side sectional view one of the many possible to be designed and constructed interchangeable choke tube for the shot load of smoothbore shotgun which causes to the shot load gradually initial tightening of progressive form, expansion and final retightening (7), featuring initial tightening of progressive form section (8) followed by expansion section (9) and which is followed by final retightening section (10) of the shot load and in which the initial tightening of progressive form section (8) is formed by curve shaped surface reducing the inner diameter, the expansion section (9) is formed by curve shaped surface increasing the inner diameter and the final retightening section (10) is formed by curve shaped surface reducing the inner diameter again.

DETAILED DESCRIPTION OF THE INVENTION

To increase the effectiveness of the smoothbore shotguns there is a constriction at the last before the exit front part of the internal of the barrel (1), i.e. reduction of the internal diameter in the muzzle area in relation to the rest of the bore of the barrel (1), in order to tighten the shot charge so that the shot pellets maintain effective density of their pattern without gaps etc. at a longer distance from the muzzle than the one at which they would had lost it due to significant spread if there was no the constriction at the exit of the barrel (1). This constriction varies depending on the distance at which is sought to be achieved the most effective in its density shot pattern diameter, from negative to small for shots at short distances, moderate for shots at medium distances and great for shots at long distances, with all intermediate gradations according to the intended use of each shotgun. In modern technology shotguns of recent decades, the part of the interior of their barrel (1) at which there is the constriction is interchangeable, ie before the exit of the barrel (1) there is internally a placement slot (5), at which is placed interchangeable choke tube for the shot load of shotgun (2) with fixation screw thread (3), which has internally the at each time desired by the user of the weapon constriction.

It is observed that, during the phase of detonation, because the shot charge, pushed by the gases produced from the combustion of gunpowder is accelerated within a few milliseconds from zero to hundreds of meters per second, a number of shot pellets, due to the very high pressure from behind, undergo cold type welding and form aggregates consisting of 2 or more shot pellets. These aggregates, as they do not have spherical shape, in the course of the shot charge in the air after its exit from the barrel (1), are diverted from the desired path to the target, thereby reducing the effectiveness of the shot. Furthermore, as they cause diversion to other nearby them shot pellets, worsen even further the reduction of the effectiveness of the shot.

The interchangeable choke tube for the shot load of smoothbore shotgun which causes to the shot load gradually initial tightening of progressive form, expansion and final retightening (7) of the present invention achieves the improvement of the effectiveness of the shot as, first, the initial tightening of progressive form section (8) featured applies to the shot charge, as it passes through it, vertical lateral pressure which splits the aggregates of shot pellets and second, the expansion section (9) which follows causes ameliorative rearrangement of the shot pellets as they are deploying in a space with larger diameter and, in this way, and their smoother entrance into the final retightening section (10) with result the improvement of the distribution of the shot pellets within their pattern during their course after their exit from the barrel (1).

According to the present invention, the interchangeable choke tube for the shot load of smoothbore shotgun which causes to the shot load gradually initial tightening of progressive form, expansion and final retightening (7), has internally initial tightening of progressive form section (8) followed by expansion section (9) and which is followed by final retightening section (10) of the shot load.

According to the present invention, the initial tightening of progressive form section (8) abuts either the beginning of the interchangeable choke tube for the shot load of smoothbore shotgun which causes to the shot load gradually initial tightening of progressive form, expansion and final retightening (7), and therefore the entrance of the shot pellets is carried out directly in to it, or a cylindrical section which is the entrance of shot pellets that is before the initial tightening of progressive form section (8) and which is interposed between them.

The initial tightening of progressive form section (8) is formed either by inner diameter reduction of conical shape or by curve shaped surface-es reducing the inner diameter, and abuts either the expansion section (9) or a cylindrical section which is interposed between them.

The expansion section (9) is formed either by inner diameter increase of conical shape or by curve shaped surface-es increasing the inner diameter or has the shape of a cylinder with base diameter larger than that of the initial tightening of progressive form section (8) and abuts either the final retightening section (10) or a cylindrical section which is interposed between them.

The final retightening section (10) is formed either by inner diameter reduction of conical shape or by curve shaped surface-es reducing the inner diameter, and abuts either the end of the interchangeable choke tube for the shot load of smoothbore shotgun which causes to the shot load gradually initial tightening of progressive form, expansion and final retightening (7) and therefore the exit of the shot pellets is carried out directly out of it, or a cylindrical section which is the exit of the shot pellets and is after the final retightening section (10) and which is interposed between them.

What is claimed is:

1. An interchangeable choke tube for a shot load of a smoothbore shotgun which causes an initial tightening of progressive form, an expansion, and a final retightening of the shotload, characterized by: an initial tightening of the shotload by a progressive form section, followed by a expansion section having a larger inner diameter than an inner diameter of the progressive form section, which is followed by a final retightening section having a narrower inner diameter than the expansion section, whereby the improvement of the effectiveness of the shotload is provided by the initial tightening of the progressive form section, an ameliorative rearrangement of the shot pellets while passing through the expansion section, resulting in the shot pellets having a smoother entrance into the final retightening section, thereby resulting in the improvement of the distribution of the shot pellets within their pattern during their course of travel after their exit from the barrel.

2. The interchangeable choke tube of claim 1 wherein the initial tightening of the progressive form section abuts the entrance of the choke tube.

3. The interchangeable choke tube of claim 1 wherein the progressive form section has a cylindrical section entrance.

4. The interchangeable choke tube of claim 1 wherein the initial tightening of the progressive form section is formed by reducing the inner diameter of the progressive form section by having a conical shape.

5. The interchangeable choke tube of claim 1 wherein the initial tightening of the progressive form section is formed by a curved shaped surface reducing the inner diameter.

6. The interchangeable choke tube of claim 1 wherein the initial tightening of the progressive form section abuts the expansion section.

7. The interchangeable choke tube of claim 1 wherein a cylindrical section is interposed between the progressive form section and the expansion section.

8. The interchangeable choke tube of claim 1 wherein the expansion section has a conical shape.

9. The interchangeable choke tube of claim 1 wherein the expansion section has an increasing inner diameter.

10. The interchangeable choke tube of claim 1 wherein the expansion section has a cylindrical shape with a base diameter larger than the initial tightening of the progressive form section.

11. The interchangeable choke tube of claim 1 wherein the expansion section abuts the final retightening section.

12. The interchangeable choke tube of claim 1 wherein a cylindrical section is interposed between the expansion section and the final retightening section.

13. The interchangeable choke tube of claim 1 wherein the final retightening section is formed by a reducing inner diameter having a conical shape.

14. The interchangeable choke tube of claim 1 wherein the final retightening section is formed by curved shaped surfaces reducing the inner diameter.

15. The interchangeable choke tube of claim 1 wherein the final retightening section has a cylindrical section exit for the shot pellets.

* * * * *